United States Patent [19]

Lamb

[11] 4,179,830

[45] Dec. 25, 1979

[54] ADJUSTABLE FRAME FOR STRETCHING SHEET MATERIAL

[76] Inventor: Terrence R. Lamb, 3549 S St., NW., Washington, D.C. 20007

[21] Appl. No.: 913,243

[22] Filed: Jun. 6, 1978

Related U.S. Application Data

[63] Continuation-in-part of Ser. No. 823,111, Aug. 9, 1977, Pat. No. 4,144,660.

[51] Int. Cl.[2] ..... D06C 3/08

[52] U.S. Cl. ..... 38/102.5; 38/102.8; 160/378

[58] Field of Search ..... 38/102.5, 102.8, 102.91; 160/345, 378, 404; 101/127.1; 140/108, 109, 110; 40/155

[56] References Cited

U.S. PATENT DOCUMENTS

| | | | |
|---|---|---|---|
| 82,602 | 9/1868 | Colby | 160/378 |
| 898,047 | 9/1908 | Harford | 38/102.8 |
| 1,443,923 | 1/1923 | Nercam | 38/102.8 |
| 1,446,367 | 2/1923 | Zelan | 40/155 |
| 3,211,089 | 10/1965 | Messerschmitt | 160/378 X |
| 3,482,343 | 12/1969 | Hamu | 38/102.5 |
| 3,485,165 | 12/1969 | Hughes | 101/127.1 |
| 3,830,278 | 8/1974 | Packer | 38/102.91 X |
| 3,914,887 | 10/1975 | Newman | 38/102.8 |
| 3,978,905 | 9/1976 | de Lama et al. | 38/102.91 X |

*Primary Examiner*—Louis Rimrodt
*Attorney, Agent, or Firm*—Fleit & Jacobson

[57] ABSTRACT

An adjustable frame for stretching sheet materials, such as canvas paintings, is disclosed. The frame comprises a plurality of individual frame segment members; and means for interconnecting and/or adjusting, the separation of adjacent frames. The sheet material or canvas is stretched by adjusting or separating the frame segments from adjacent segments to thus expand the overall dimension of the frame. The individual frame and corner segment members comprise light weight, substantially hollow structures which are easily manufactured, yet very sturdy in construction. The framing device of the invention is particularly adapted to be manufactured from light weight plastic materials which offer distinct advantage over known wooden frames. The framing device of the invention is particularly suitable for mounting very expensive oil paintings or masterpieces and overcomes the difficulties of known frames.

11 Claims, 17 Drawing Figures

ADJUSTABLE FRAME FOR STRETCHING SHEET MATERIAL

RELATIONSHIP TO CO-PENDING APPLICATION

The present application is a continuation-in-part of U.S. Ser. No. 823,111 filed Aug. 9, 1977, now U.S. Pat. No. 4,144,660, Mar. 20, 1979.

BACKGROUND OF THE INVENTION

1. Field of the Invention

The present invention relates to a framing device for stretching sheet materials and, more particularly, to an unique adjustable stretching frame for mounting canvas paintings.

2. The Prior Art

As is well known in the art, canvas paintings are conventionally mounted on wooden frames which are sometimes referred to as canvas frame stretchers. Known frames typically comprise wooden frame elements fastened together at the four corners with braces. The standard technique for stretching a canvas painting or other sheet material about a frame involves stapling a portion of the canvas to the edge of the frame and thereafter draping the canvas over the opposite side of the frame and manually stretching it about the frame. When the canvas is stretched to the required degree, it is stapled to the frame.

In recent years, a number of adjustable frames have also been disclosed with specific examples thereof being shown in U.S. Pat. Nos. 3,482,343 and 3,914,887. While a number of such frames are known in the art, they suffer from serious disadvantages and/or deficiencies. One disadvantage lies in the fact that known frames are very difficult to use and are expensive to manufacture. A further problem of presently known and/or commercially available framing devices is that they are not designed such that they may compensate for any expansion and/or contraction of the painting due to changes in temperature or humidity.

The above disadvantages of known frames is particularly acute when mounting very expensive canvas paintings or works of art. It may be briefly noted here that the mounting and/or restretching of an expensive canvas is a highly skilled art involving much expertise. For example, when dealing with a masterpiece, the tension placed on the canvas must be closely controlled. This tension will vary widely between paintings. Further, while known frames may have corners which are generally adjustable, they are adjustable only in one direction. Thus, the canvas must be removed along the entire side that is being restretched. Removing the canvas in this manner is a significant problem inasmuch as it is essential, with valuable works of art, that they not be touched even by the tip of one's finger. Fingerprints lead to the cracking and deterioration of the painting.

A further problem facing this art is the deterioration of a canvas painting with age. While the precise theory, or underlying cause, for the deterioration is not fully known, it has been found that canvas paintings will deteriorate at the point of contact of the painting with the canvas. This deterioration is typically along the front outer edges of the frame. It is believed that this damage is due to the reaction of the oils or paint with the material (i.e., wood) of the frame itself. As a further point with regard to known stretching apparatus or frames, in stretching a canvas, it is important that the tension exerted between the frame and the canvas be adjustable in order to prevent premature damage to the canvas. This operation requires a great amount of tension to maintain the canvas in a taut condition over the frame. It is also highly desirable, when stretching or restretching certain canvas paintings, (especially those that are aged) to stretch them at different tensions along different portions of the canvas. This is frequently necessary after the canvas has been mounted for a number of years and certain portions of the canvas have become loosened or stretched. With existing frames, it is not possible to retighten or restretch the canvas without removing the canvas from the frame. The present invention relates to an apparatus that overcomes the above noted deficiencies of known devices.

SUMMARY OF THE INVENTION

The present invention relates to a novel frame for stretching sheet materials which, in its broadest aspect, comprises an improvement and advance over the novel framing device disclosed in the U.S. patent application Ser. No. 823,111, filed Aug. 9, 1977, now U.S. Pat. No. 4,144,660 granted Mar. 20, 1979.

In this regard, in accordance with the teachings of the above-noted patent application, which is deemed to be incorporated herein by reference, the various frame segment members that compose the overall frame are interchangeable so that the user of the device may use any number of separate individual frame segment members arranged in any shape or size. The canvas painting is draped over the frame and secured to the rear side of the frame by any suitable means such as staples. Thereafter, the various frame segment members are adjusted with respect to each other so that they separate, relative to adjacent segments, thus expanding the overall dimensions of the frame and stretching the canvas to the desired tension. In a preferred apparatus embodiment of this application, a flexible beading is mounted and secured to the front edge portion of the periphery of the frame in a manner such that it is raised from the front face of the frame.

In summary, the present invention relates to a further and improved adjustable canvas stretching frame that comprises, again broadly speaking for the moment, a plurality of individual frame segment members, means for interconnecting the frame segment members with each other, and means for adjusting the separation between adjacent frames. In accordance with the present invention, the individual frame segment members, as well as the corner segment members, may be separated from each other to adjust the overall dimension of the frame. In this manner the canvas, once mounted to the frame, can be stretched as desired yet while maintaining the overall shape of the frame. In the practice of the invention, the individual frame and corner segment members comprise light weight, hollow structures which may be easily manufactured and yet, when assembled to form the unique adjustable stretching frame of the invention, are very sturdy in construction. The materials of construction of the novel device of the invention may be of varying materials. However, in a particularly preferred advantageous embodiment, the frame is constructed of a light-weight synthetic material which is not subject to the disadvantages associated with wood, yet is adaptable to receive conventional tacks or staples. Known adjustable prior art frames are typically complex metallic structures which require metal clamps for securing the canvas to the frame.

It is accordingly a general object of the present invention to provide a stretching frame that permits adjustable substantially unlimited adjustments over the entire periphery of the frame.

A further object of the invention is to provide an adjustable canvas stretching frame having corner segment members which may be separated from each other so as to adjust the overall dimension of the frame.

A still further object of the invention is to provide an adjustable canvas stretching frame that comprises a plurality of individual light-weight frame segment members which are interconnectable with each other in a manner to form a very sturdy, yet adjustable frame.

Yet still a further object is to provide a canvas stretching frame which is simple in design and construction, is very reliable in operation and economical to manufacture.

Yet another object is to provide an adjustable frame from light-weight synthetic materials, such as plastic, and which overcome the problem associated with known wooden frames.

Yet another object of the invention is to provide a framing device which is designed such that it is continuously adjustable along the periphery of the frame, this structure, however, not interferring with the stapling of the canvas to the frame.

BRIEF DESCRIPTION OF THE DRAWINGS

The manner in which the foregoing and other objects are achieved in accordance with the present invention will be better understood in view of the following detailed description and accompanying drawings wherein.

DESCRIPTION OF THE PREFERRED EMBODIMENT(S)

As briefly noted above, the present invention relates to a novel frame member for stretching sheet material and, more particularly, to a canvas-stretching frame that is adjustable along its entire periphery. Stated broadly, the apparatus of the invention comprises adjustable corner segment members and a plurality of individual, substantially hollow frame segment members, which in combination with said corner segments, are interconnectable to form a frame of any given predetermined size and shape. In the practice of the invention, means are provided for interconnecting the frame and corner segment members and for adjusting the separation between adjacent frame and corner segments.

Figures 1, 1A, 1B:
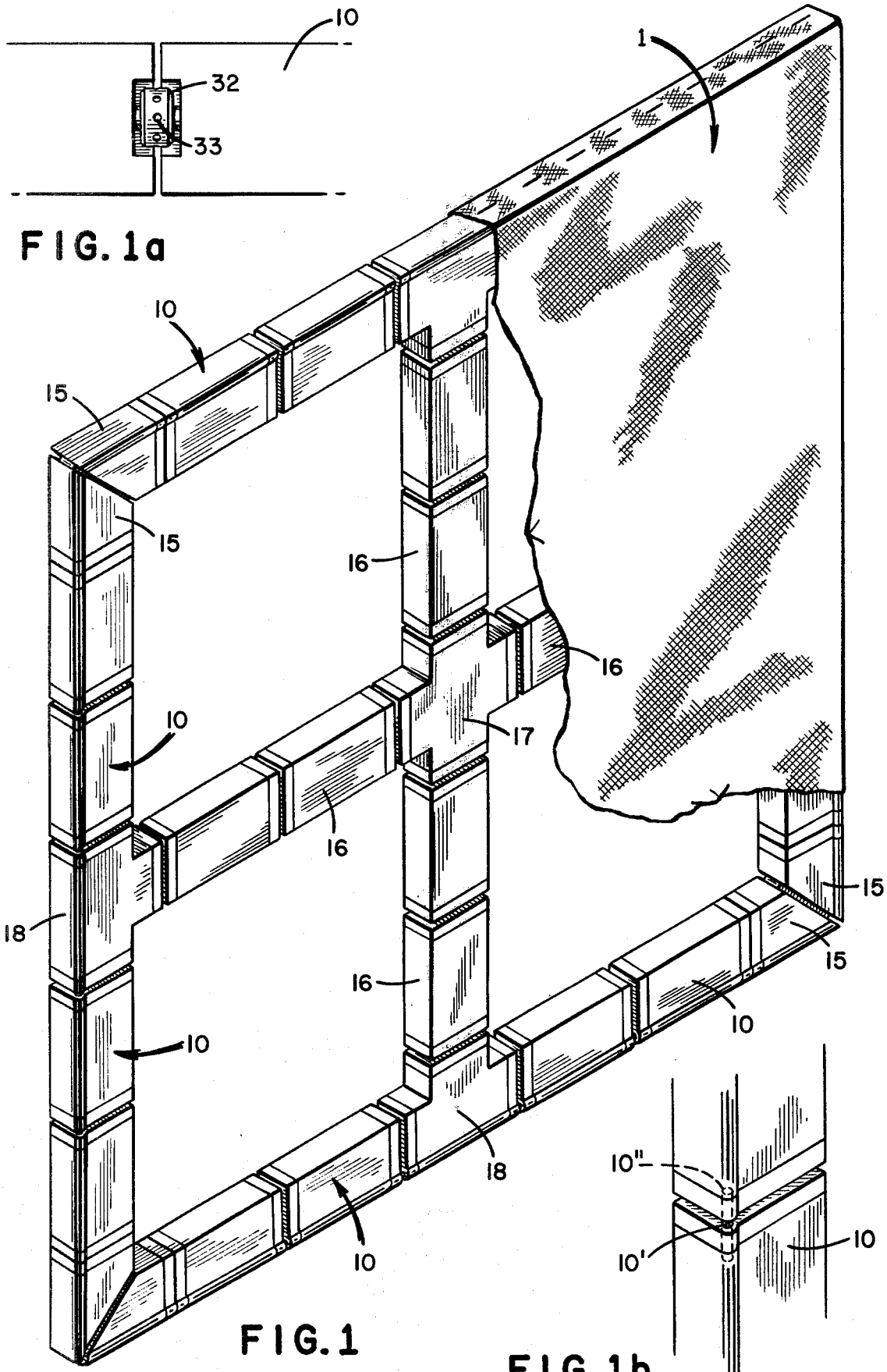
FIG. 1 is a perspective view illustrating a particularly advantageous apparatus embodiment of the novel adjustable stretching frame of the instant invention.
FIG. 1*a* is a rear elevation illustrating a portion of the frame where two typical frame segments adjustably abut.
FIG. 1*b* is an enlarged view illustrating a retaining pin positioned at the front edge portion of adjacent frame segments.
Figure 2:
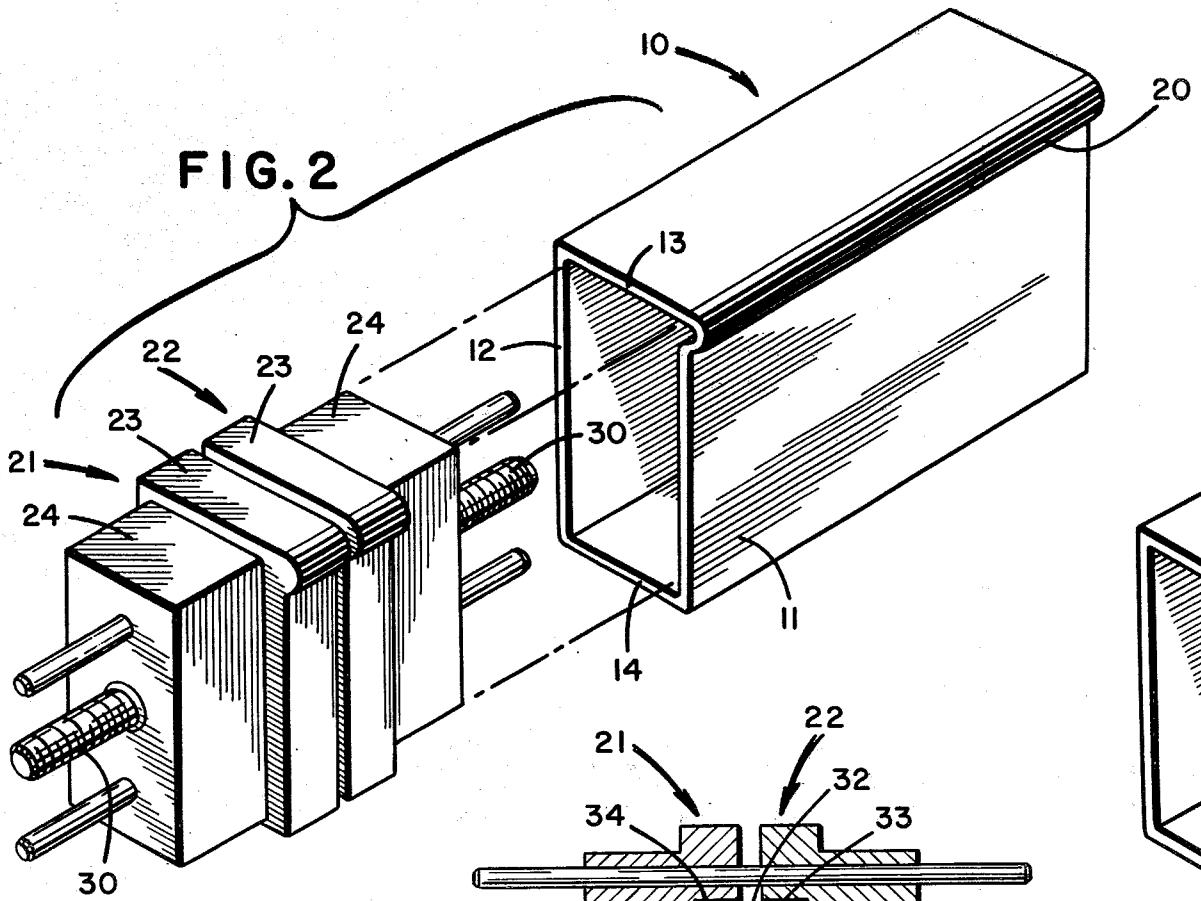
FIG. 2 is an exploded perspective illustrating a preferred means for interconnecting adjacent frame segments.
Figure 3:
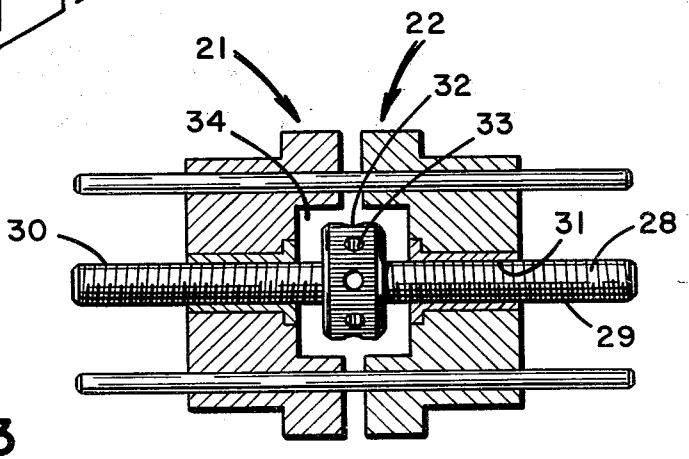
FIG. 3 is a longitudinal section taken through the coupling member shown in FIG. 2 and employed to connect adjacent frame segments.

In this regard and turning now to more specific details of the invention, and with reference first to FIGS. 1–3, the apparatus of the invention comprises a plurality of individual hollow frame segment members, indicated generally at 10, which as best shown in FIG. 2, comprise and are defined by, substantially parallel sidewalls 11 and 12, and connecting upper and lower walls 13 and 14. The frame further includes corner segment members 15 which, as to be discussed in more detail hereinafter, can be separated and adjusted relative to each other, the latter serving to stretch the canvas while at the same time maintaining the shape of the frame. As illustrated, e.g., in FIG. 1, the individual frame segments 10 are interchangeable so that the framer may use any number of separate segment members, arranged in any predetermined size or shape, without having to have a custom built frame. The length of the individual segments 10 may be varied over a wide range. For example, for a standard and/or relatively inexpensive frame, the frame segments 10 are preferably relatively long in length, i.e., greater than 10 inches. The use of relatively short frame segment members, however, permit more extensive adjustments and are thus preferred for expensive paintings or works of art.

Figure 4:
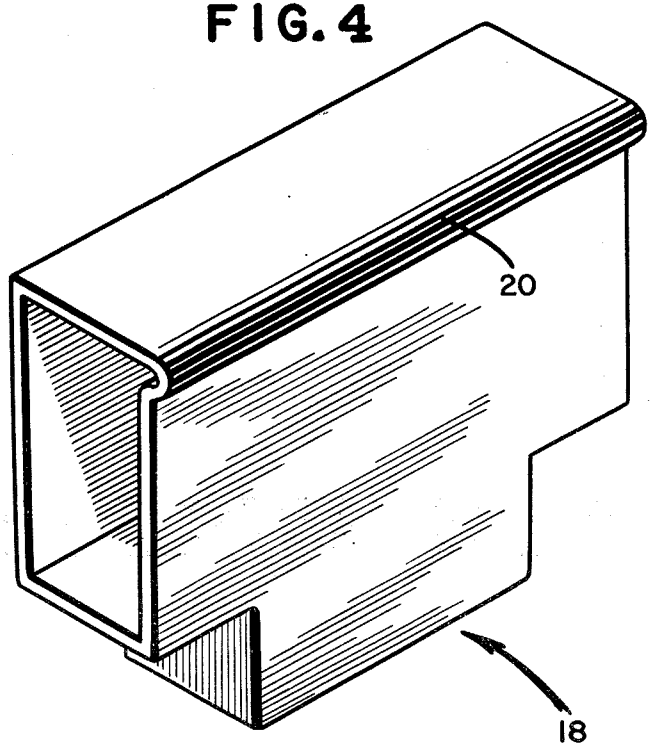
FIG. 4 is an enlarged perspective illustrating a T-shaped segment member employed for interconnecting cross-framing segment members that may be employed in the practice of the invention.

In the embodiment illustrated in FIG. 1, interconnecting cross-frame segment members 16 are provided to enhance the overall strength of the frame. While the strength provided by the basic construction of the frame itself, is generally sufficient, the use of the cross-bracing is preferred. This would be particularly true for very expensive canvas paintings with the embodiment shown in FIG. 1 being the preferred embodiment in this instance. The cross-bracing frame segments 16 are similar in construction and design to segment members 10, except that they do not include the raised beaded portion, indicated at 20, in FIG. 2. The raised portion 20, as well as its use and advantages are to be discussed hereinbelow. The cross-bracing further includes a centering member 17 and substantially T-shaped frame segments 18, the details of the latter being shown, e.g., in FIGS. 1 and 4.

With reference now to FIGS. 2 and 3, the frame segment members 10 are preferably interconnected and adjusted relative to each other by a pair of opposed and mating block coupling members indicated at 21 and 22. As shown in FIG. 2, each coupling member comprises a first enlarged portion 23 which is identical in size, shape and cross-section to the individual frame segment members 10. Substantially rectangularly block portions 24 are formed integrally with the enlarged portions 23 which, as best shown in FIG. 2, are adapted to mate and fit within the interior or cavity or hallow interior formed by the four walls of the frame segments 10. An elongated rod 28, having opposing left-right threading 29 and 30, is threadly positioned within internally threaded grooves 31 formed in each coupling member as best shown in FIG. 3. A nut 32, threaded on the bolt 29, note, e.g., FIG. 2, is provided to adjust the coupling members relative to each other. In this regard, a conventional tool, such as an allen wrench, may be employed for turning the threaded nut in either direction on the bolt so as to adjust (i.e., open and close) the separation between adjacent frame segment members 10. In the embodiment illustrated in the drawings, the nut comprises a threaded circular member which includes openings 33 positioned around the periphery thereof for receiving an allen wrench. The allen wrench or like tool is inserted into the opening or cut-out portion 34 and the wrench is rotated to effect displacement of the adjacent frame members. The opening 34 extends from the central portion of each coupling member and outwardly to the rear face of each member. See, e.g., FIG. 1*a*, which is a rear elevational view of a portion of the framing device shown in FIG. 1. The canvas, once mounted, may thus be easily stretched by a simple turning of the handle of the tool or wrench. Such operation involves a minimum of time and effort and little mechanical expertise.

Figure 6:
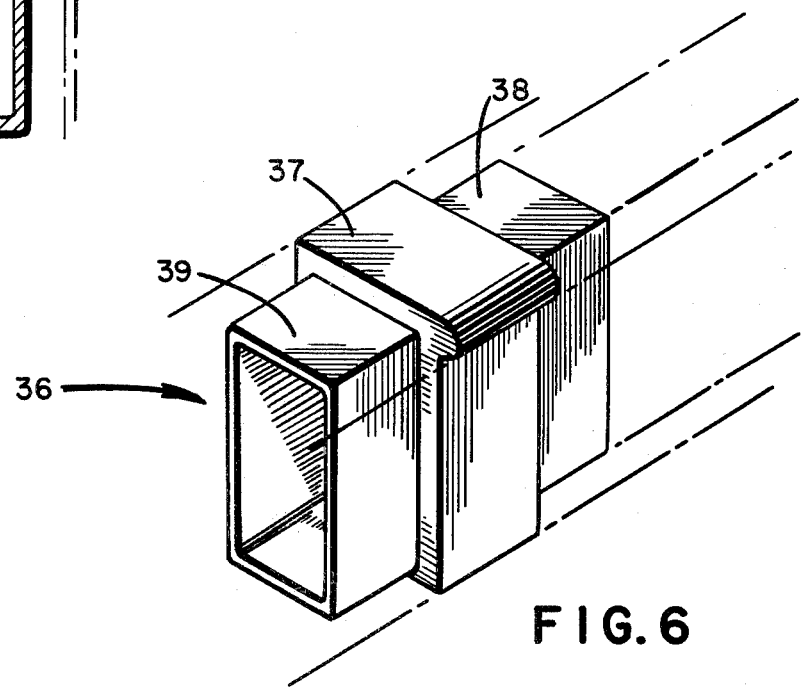
FIG. 6 is a perspective view illustrating non-adjustable coupling members.
Figure 7:
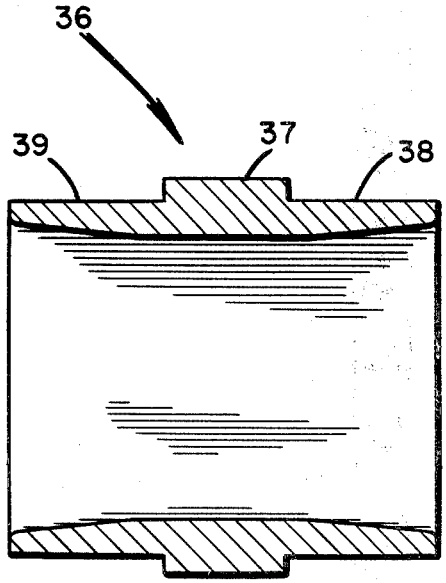
FIG. 7 is a longitudinal section of the element shown in FIG. 6.

Although the mechanical coupling members are preferred, non-adjustable one-piece coupling members, indicated at 36, in FIGS. 6 and 7 may be used, e.g., when the nature of the canvas painting or the size of frame, etc., is such that precision adjustment is not required. Thus the non-adjustable coupling members could be used alternatively between adjustable coupling members, etc. As clearly shown in FIG. 6 and 7, the non-adjustable coupling members (36) are identical in size and shape to the mechanical couplers and include, a central enlarged portion 37 which corresponds to the size and shape of the frame segments (10), and opposed block-shaped ends, 38 and 39 respectively, which are adapted to fit within the hollow interior of the frame segments.

As previously noted, the canvas stretching frame is adjustable along the entire periphery of the frame. A particularly unique aspect of the invention includes the design of the corner portions of the frame which may be mechanically separated from each other, along a 45 degree angle formed by the mating and adjacent sides or edges of the corner segments, to adjust the overall dimensions of the frame and to stretch the canvas at its corner edges and along the sides of the frame. In this regard, and with reference to the embodiments illustrated in FIGS. 7 and 8, the frame includes hallow corner frame segment members 15, each corner member being of generally trapezoidal shape and having two parallel sides 40 and 41; a furthermost edge 42 and a side edge 43, the latter extending at a 45° angle with the parallel sides 40 and 41. The individual corner frame segment members are adapted to mate with each other when the frame is assembled as shown in the drawings.

It should be noted at this point that a particularly remarkable mechanical design aspect of the present invention lies in the fact that the corner frame segment members 15 are adapted to move relative to each other and along the 45° angle formed by the side edges 43 of the opposed corner segment members 15. Also, in accordance with the invention, the canvas may be stretched after it is secured to the frame. This is not possible with prior known stretching frames. For example, in U.S. Pat. No. 3,978,905, there is disclosed a frame for holding an artist's canvas which includes four corners that mate with each other and having angle brackets 46 for securing the corner edges relative to each other. However, in this patent the frame is rigid and non-expandable, i.e., is not adapted to open and close. Furthermore, and very importantly once the canvas is mounted on the frame (of this patent), such as shown, e.g., in FIG. 9, the corners cannot be moved relative to each other. U.S. Pat. No. 3,830,278 discloses a modular stretcher which again is not adapted for mechanical adjustment once the canvas has been stretched onto the frame. In this patent, a bracket 15 is used to secure the frame at its corners. However, once the canvas is wrapped about the frame as best shown, for example, in FIG. 4, and is secured thereto by a fastener 52 (note this is an aluminum frame having a rubber strip 30 to receive the metallic fastener) no mechanical adjustment and/or stretching of the canvas is possible.

In U.S. Pat. No. 3,211,089, there is disclosed a screen printing apparatus that includes corner members 3 which, although adjustable, are not adjustable along a 45° angle formed between the opposing corner pieces but merely are capable of being moved in a direction relative to that of the shank member 5. This device is, of course, adapted for silk screen printing with the screen netting itself being secured to the main frame unit as shown in FIG. 1. U.S. Pat. No. 3,482,343 further discloses a silk screen printing apparatus that includes adjustable corner members. Again, however, the corners are movable only in direction relative to the four sides of the frame. Any canvas stretched about the frame disclosed by this patent could thus not be stretched at its corners. Note, e.g., FIGS. 1, 2 and 3 of this patent.

Figures 8, 9:
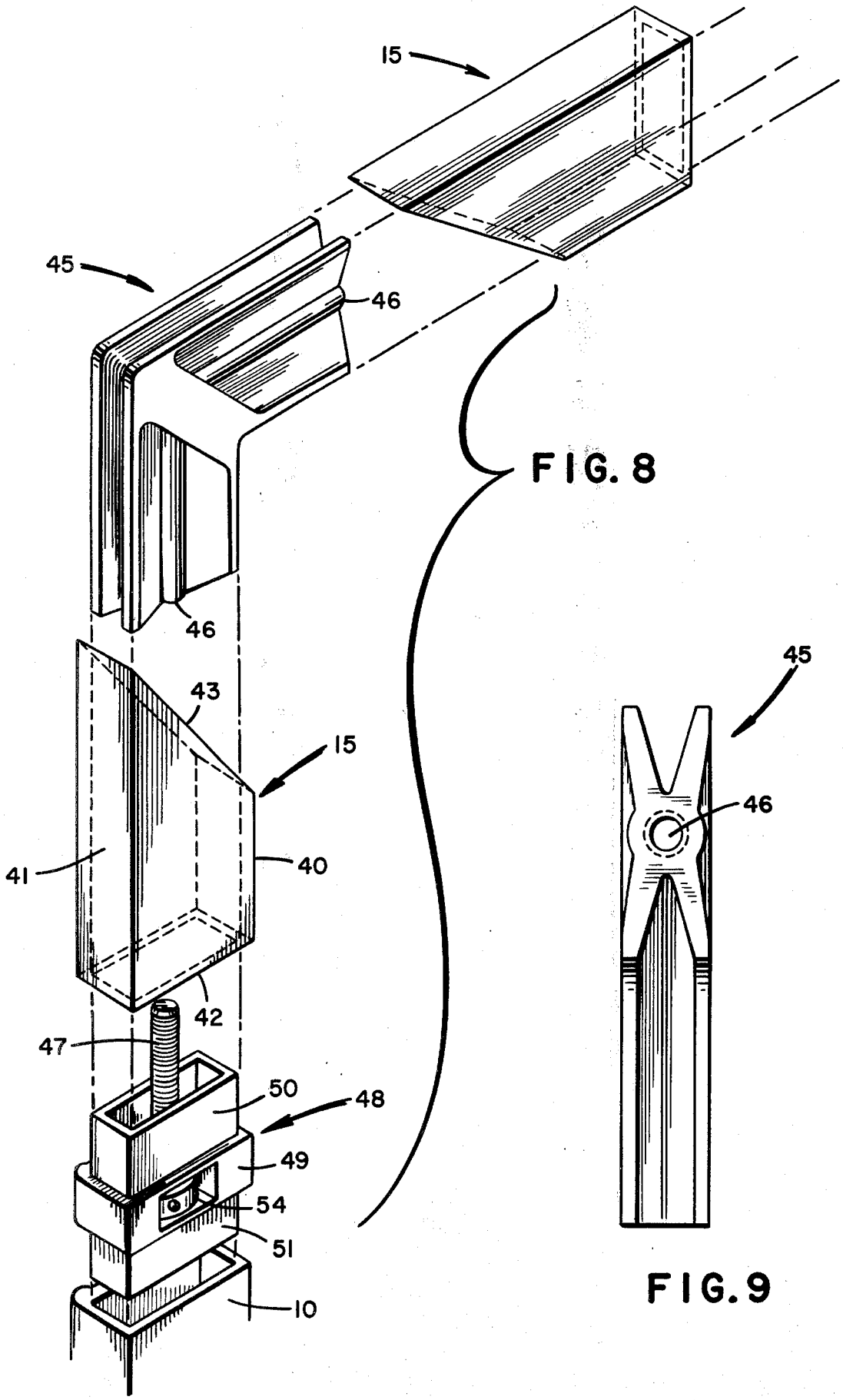
FIG. 8 is an enlarged perspective illustrating a preferred structural embodiment comprising the corner segments of the framing device of the invention and the manner in which same are interconnected and adjusted.
FIG. 9 is an end view of the corner coupling member shown in FIG. 8.

Turning again to the details of the invention, in the embodiments shown in FIGS. 8 and 9, the means for interconnecting the corner frame segment members comprise four substantially L-shaped corner plates 45. Each corner plate has a thickness less than that of the corner frame segments and is adapted to be fitted within the opening formed in the angled side edge 43. The corner plates are preferably constructed of a material that has a strength at least equal to, and preferably greater than, that of the individual frame segment members. The plates are preferably formed of a synthetic product or plastic, such as high impact polystyrene, polyethylene, PVC, etc. In prior art frames, damage to the paintings caused by the stretching most often occurs at the corners. The present invention overcomes this significant difficulty. As clearly shown in FIGS. 8–9, the corner plates are designed such that each arm of the L is substantially X-shaped in cross-section. This design serves to significantly increase the strength of the corner plate itself as well as to reduce its overall weight. As internally threaded aperture 46 is formed centrally of the X-shaped cross-section and is adapted to receive a threaded bolt 47 of the corner coupling members, indicated at 48 in FIG. 8. The latter, i.e., the coupling means 48, is preferably the same design as the frame segment coupling members 22 except that bolt 46 has only a one-way thread. Also, the housing forming the coupling member 48 is not bifurcated, being of a one-piece construction having an enlarged central portion 49 and opposed end portions 50 and 51. The end portions 50 and 51 fit within the mating hallow ends of the frame and corner segments, 10 and 15 respectively, in a manner similarly as the block coupling members 21 and 22. Note here that the block shaped ends of the coupling members are preferably press fitted within the hallow interior of the frame segments. They may, however, be permanently affixed thereto as by gluing or by other known means such as a small screw, etc.

Figure 10:
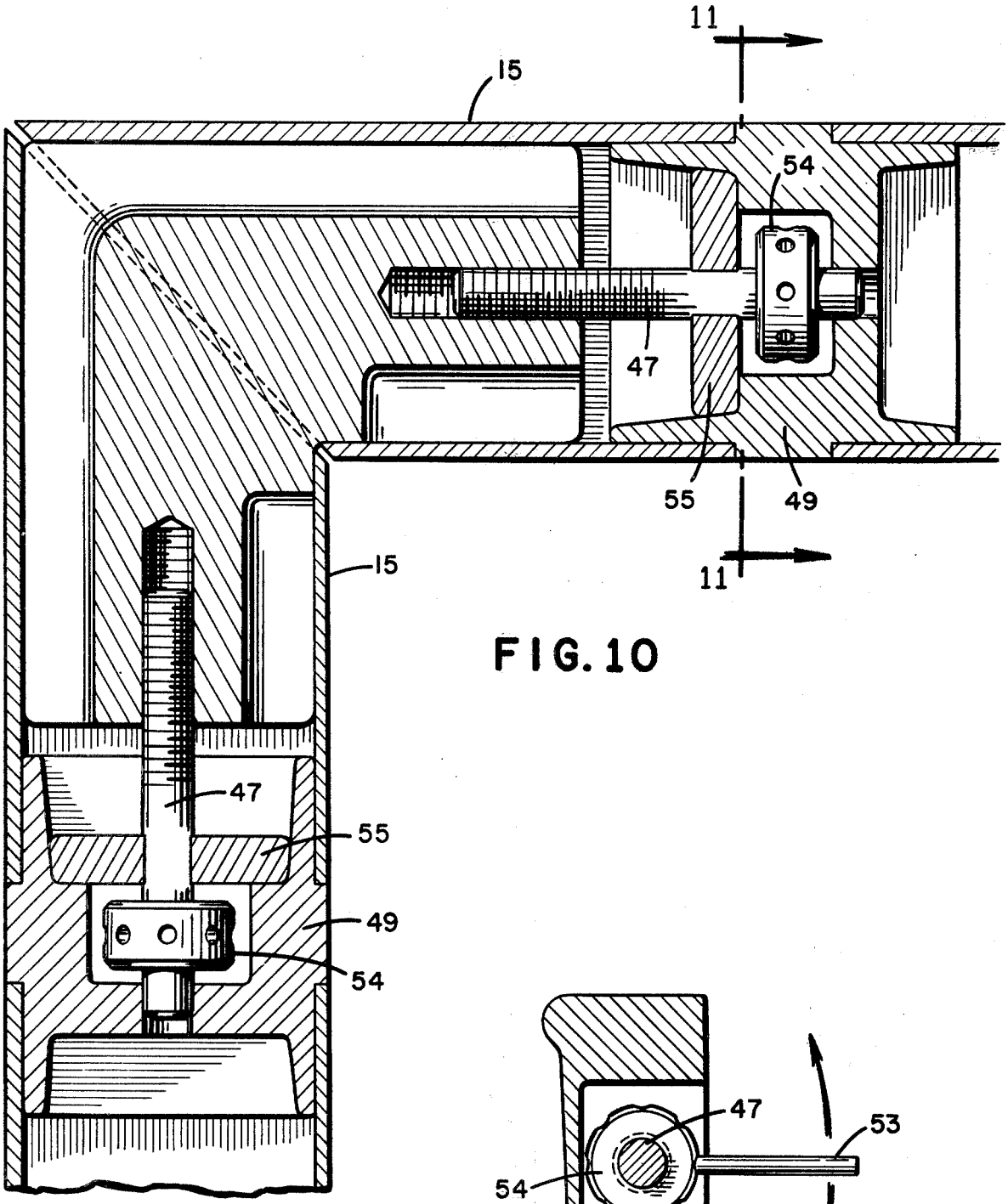
FIG. 10 is a longitudinal section of the unit illustrated in FIG. 8 except in the assembled condition.
Figure 11:
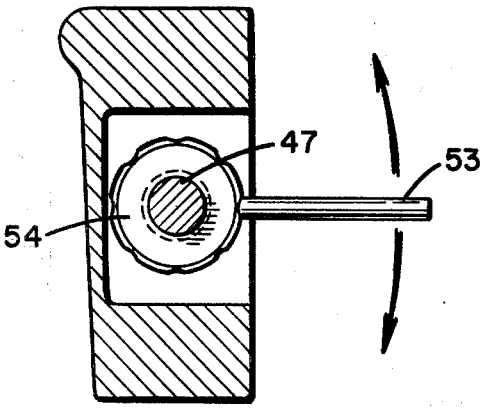
FIG. 11 is a section taken along lines 11—11 of FIG. 10.

The corners are assembled and adjusted relative to each corner segment in the manner as shown in FIGS. 10, 11 and 12*a–c*. This operation involves placing the mating and opposed corner segments 15 over the L-shaped corner plate 45 and with the use of an allen wrench or similar tool, (the handle of the latter being indicated at 53 in FIG. 11), turning the nut 54 which serves to rotate and advance the bolt 47. As shown in FIG. 10, the corner coupling member 48 includes a bolt support ring or guide 55 positioned within the housing that defines the coupling unit.

Figure 12A:
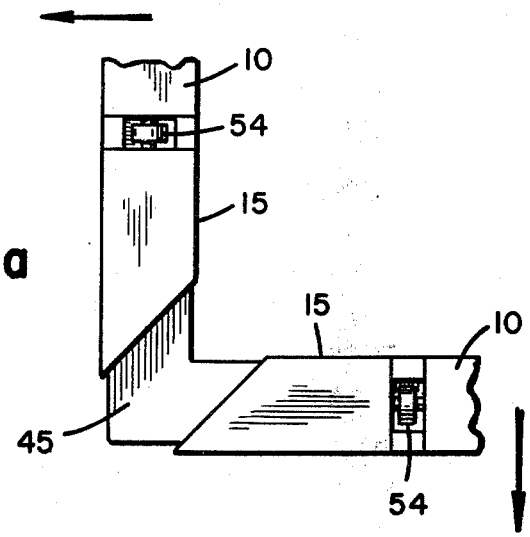
FIGS. 12*a*, 12*b* and 12*c* comprise diagrammatic illustrations of the corner segments in their varied expanded and contracted conditions.
Figure 12B:
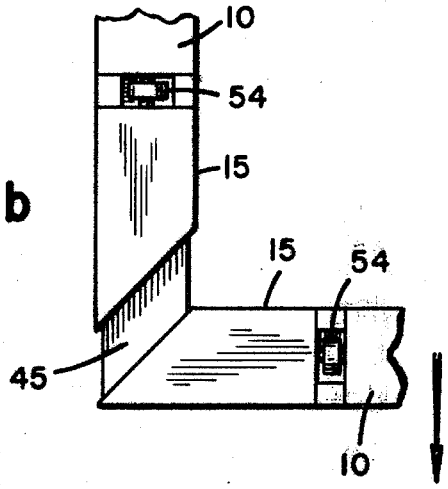
Figure 12C:
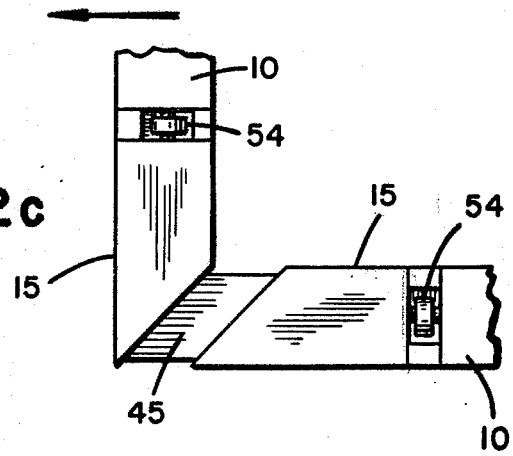

FIGS. 12*a*, 12*b* and 12*c* strikingly illustrate the manner in which the corners may be adjusted. In FIG. 12*a* each corner of the frame has been opened or moved apart from each other, again simply by turning or rotating the nut 54 for each corner coupling unit 48. The separation required for stretching the canvas would normally be very small compared to that shown in FIG. 12*a*, the latter being for illustrative purposes only. In FIGS. 12*b* and 12*c*, only a single corner segment has been adjusted relative to the opposed segment, again this being for illustrative purposes only and as representative of the truly unique mechanical design of the invention.

In the practice of the invention, the individual frame segment members are interconnected in the manner as stated hereinabove and the canvas, indicated generally at 1 in FIG. 1, is mounted onto the front face of the frame and secured to the rear side thereof by conventional means, e.g., as by stapling. By adjusting the individual frame and corner segments by way of the threaded nut, the individual segment members are separated from adjacent members thereby expanding the overall dimension of the frame. The latter serves to stretch the canvas over the frame.

In conventionally known frames, the canvas is stretched directly over the frame and is in intimate contact therewith. However, as time passes, the canvas (more particularly the paint or oil that is used on the canvas) will react with the frame with results in the deterioration of the canvas. The canvas may also become permanently stuck to the frame. Thus, when the frame is to be restretched or remounted, it is very difficult to remove the canvas from the frame. In this connection, in the practice of the present invention, a raised portion 20 is provided near the edge of the periphery of the front of each frame segment and extends along the entire front face of each segment so that the canvas is stretched over this portion of each segment. Note, e.g., FIGS. 2 and 4. As previously stated, the cross-bracing members are not provided with the raised portion 20. In this manner, contact with the front face of the frame is substantially reduced. This arrangement not only prevents deterioration of the canvas, but also serves to maintain the rectangular shape of the canvas as it is stretched over the frame.

Figure 5:
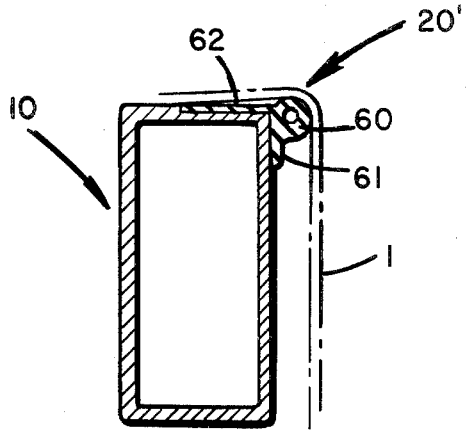
FIG. 5 is a cross-sectional view illustrating a further embodiment of the frame segment members employed in the invention.

As disclosed in detail in the U.S. patent application Ser. No. 823,111, a flexible beading 20′, such as illustrated in FIG. 5, may be used in lieu of the raised portion 20. In the embodiment shown in FIG. 5, the beading 20′ may have a substantially circular cross-sectional portion 60 and two opposing flange portions 61 and 62, the latter being substantially at right angles to each other. If this embodiment is employed, a recess or cutaway portion may be formed along the outer edge of the individual frame segment members. The beading in this instance is secured to the frame by conventional means as by gluing. As best shown in FIG. 1*b*, a small rod 10′ may be provided to "fill" the opening or space formed when opposed frame or corner segments are separated. In this embodiment the small rod is positioned within small channels or apertures 10″ formed at the opposed ends of each segment and in the area of said beading or raised portion 20.

Figure 13:
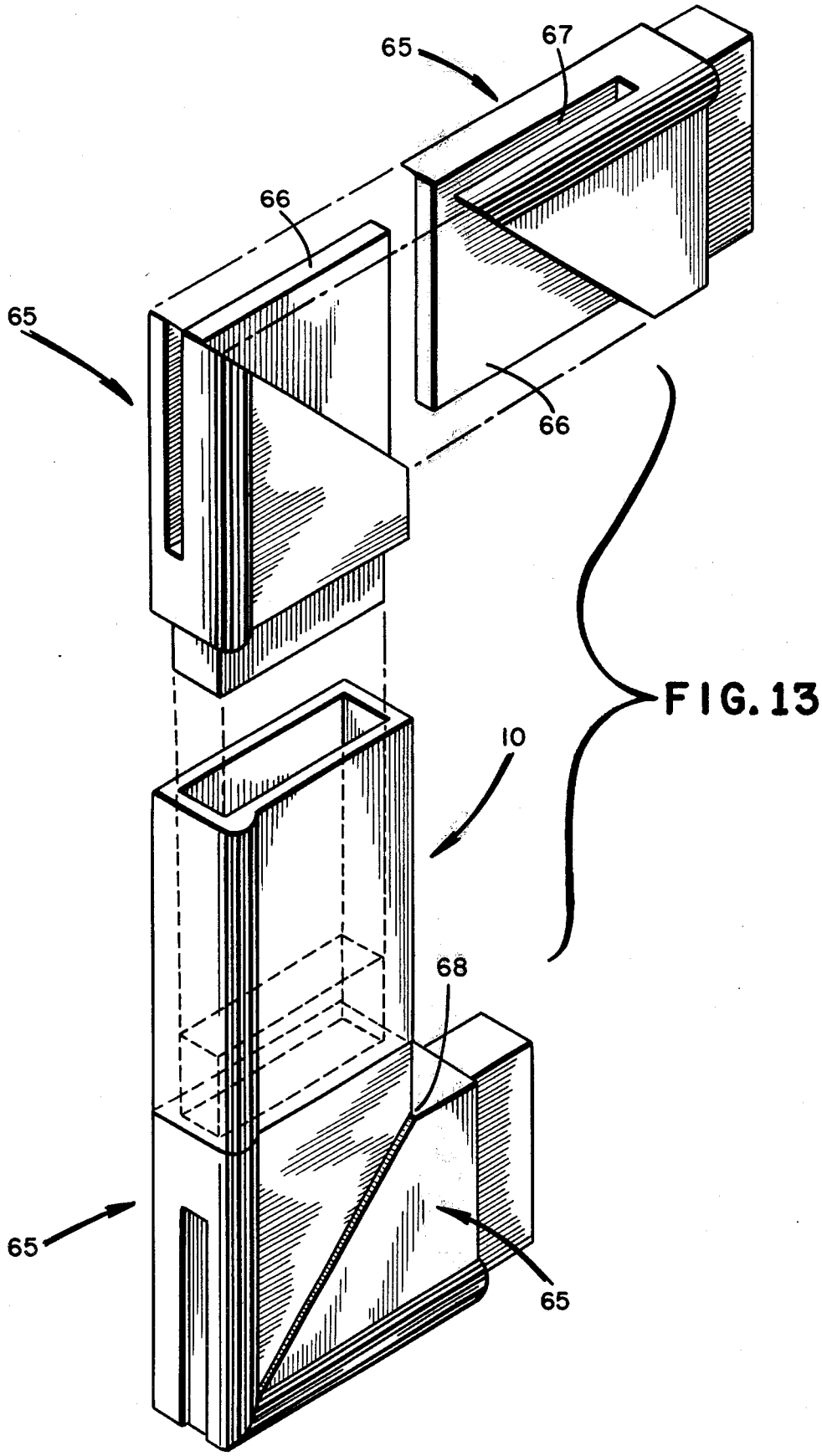
FIG. 13 is an exploded perspective illustrating a further apparatus embodiment of the corner units, the lower unit being shown in an assembled position.

From the above, it will be seen that the present invention provides a truly remarkable canvas stretching frame that is adjustable over the entire periphery of the frame. The frame is composed of a plurality of hollow individual frame segments which may be interconnected and adjusted relative to adjacent segments. The canvas painting is draped over the frame and secured to the rear side of the frame by any suitable means. Thereafter, the frame segment members are adjusted with respect to each other to expand the overall dimensions of the frame and to stretch the canvas. The unique framing device of the invention is particularly suitable for very expensive paintings and provides a framing apparatus wherein after a number of years, the canvas may be restretched and the painting remounted with a minimum of difficulty and damage to the canvas itself. While particularly preferred embodiments have been shown, it should be expressly understood that such embodiments have been given for illustrative purposes only and are not intended to limit the scope of the present invention as further defined by the appended claims. For example, while the adjusting coupling members 22, as shown e.g., in FIGS. 2 and 3 may be used and positioned between each adjacent frame segment 10, as discussed above, non-adjustable one-piece coupling members, indicated at 36 in FIGS. 6 and 7 may be employed between adjacent frame segment members for relatively inexpensive paintings or where the overall adjustment of each segment is not required. Moreover, while particularly advantageous and preferred corner segments and means for adjusting same relative to each other have been disclosed hereinabove and illustrated, e.g., in FIGS. 8–12, other embodiments could be employed without departing from the underlying generic concept of the invention. A specific example of such a further design is shown in FIG. 13. In this embodiment, the corner segments, indicated at 65, include and are defined by mating extensions 66 and recesses or grooves 67. The extensions are simply inserted into the mating grooves 67, the latter serving to form an interlocking rigid corner as shown in the lowermost portion of FIG. 13. A wedge can be inserted at the inside corner, indicated generally at 68 in FIG. 13, to separate the mating segment so as to increase the tension of the canvas at the corners thereof. This structure does not, of course, provide the mechanical adjustments as that structure shown, e.g., in FIGS. 8 and 9.

What is claimed is:

1. An adjustable framing device for stretching sheet material comprising: a plurality of hollow frame segment members having a front side over which a canvas is to be stretched; said frame segment members each having two side walls, connecting upper and lower walls which define a hollow interior and first and second ends; said framing device further comprising a pair of corner frame segment members for forming each corner of said frame, means for interconnecting one end of said frame segment members with one of said corner frame segment members to form a frame; each of said corner frame segments having two parallel upper and lower edges, a perpendicular edge adapted to mate with said one end of an adjacent frame segment member and being located at a remote position from the corner of the frame, and a side edge nearest the corner, said side edge extending at a 45° angle with respect to said parallel upper and lower edges whereby said side edges which extend at said 45° angle mate with each other when said pair of corner segments are closed to form said frame and means for interconnecting and adjusting the separation of said pair of corner frame segments.

2. An adjustable stretching frame for stretching sheet material comprising: a plurality of hollow frame segment members having a front side over which a canvas is to be stretched; means for interconnecting said frame segment members with each other to form a frame; means for adjusting the separation between adjacent frame segments; said frame segment members each having substantially two parallel side walls and connecting substantially parallel upper and lower walls which define a hollow interior; said means for adjusting said separation between adjacent frame segments comprising a bifurcated coupling member, each section of said member having an enlarged central portion and opposed block end portions adapted to fit within the said hollow interior formed by the walls of said frame segments and means for moving the opposed sections forming said coupling member to thereby adjust the separation between adjacent frame segments; said frame segment members further comprising a pair of substantially hollow corner frame segment members for forming each corner of said frame, each of said corner frame segments having two parallel upper and lower edges, a perpendicular edge located at a remote position from the corner of the frame, and a side edge nearest the corner extending at 45° angle with respect to said parallel upper and lower edges whereby said side edges which extend at said 45° angle are adapted to mate with each other; and corner plates adapted to fit with each of said opposed corner frame segments to thereby permit slidable adjustment to expand the corners of said frame.

3. The adjustable frame in accordance with claim 2 wherein said means for adjusting the separation between said adjacent frame segment members further comprises threaded bolt means having opposed left and right threads, said bolt means operably positioned within said bifurcated coupling means, and a nut threadedly secured to said bolt whereby upon rotation of said nut the bifurcated sections of said coupling member are caused to separate.

4. The adjustable frame in accordance to claim 3 wherein said corner plates include a L-shaped member, each end of said L having an internally threaded channel adapted to receive said threaded bolt mounted within said coupling.

5. The adjustable frame in accordance with claim 3 wherein said nut threadly secured to said bolt comprises a circular member having openings positioned around the periphery thereof for receiving a tool whereby when said tool is inserted into said openings, the rotation thereof serves to effect displacement of adjacent frame members.

6. The adjustable frame in accordance with claim 2 and further comprising means for slidably adjusting said corner frame segment members with relation to said corner plate mounted within said corner frame segments, said means comprising a threaded bolt mounted within a coupling defined by an enlarged central portion and opposed block end portions adapted to fit within the hollow interior of adjacent frame and corner segment members.

7. An adjustable stretching frame for stretching sheet material comprising: a plurality of hollow frame segment members having a front side over which a canvas is to be stretched; means for interconnecting said frame segment members with each other to form a frame; means for adjusting the separation between adjacent frame segments; said frame segment members each having two side walls and connecting upper and lower walls which define a hollow interior; said frame segment members further comprising a pair of hollow corner frame segment members for forming each corner of said frame, each of said corner frame segments having two parallel upper and lower edges, a perpendicular edge located at a remote position from the corner of the frame, and a side edge nearest the corner extending at 45° angle with respect to said parallel upper and lower edges whereby said side edges which extend at said 45° angle are adapted to mate with each other, and means adjustably connecting mating corner segments with each other.

8. The adjustable frame in accordance with claim 7 wherein said frame segments are formed of a plastic material adapted to receive metal fastening means for securing said canvas to said frame.

9. The adjustable frame in accordance with claim 7 and further comprising a plurality of cross-frame segment members; means for interconnecting said cross-frame segment members comprising a center member; means for interconnecting said plurality of cross frames perpendicular to each other, and means for interconnecting said cross-frame segment members with said frame segment members that form the rectangular frame.

10. The adjustable frame in accordance with claim 7 wherein said frame segment members include a raised beaded portion positioned near the front outer edge of said segments such that when said segments are assembled to define a frame, said beaded portion extends along the periphery of the front of said frame defined by said segments.

11. The adjustable frame in accordance with claim 7 wherein said means for interconnecting said frame segments comprise an integral one-piece coupling member having an enlarged central portion which has a cross section that corresponds to that of said frame segment members and further having and being defined by opposed block end portions adapted to fit within the hollow interiors defined by adjacent frame segment members.

* * * * *